US008696541B2

(12) United States Patent
Pluvinage et al.

(10) Patent No.: US 8,696,541 B2
(45) Date of Patent: Apr. 15, 2014

(54) SYSTEMS AND METHODS FOR PHOTO-MECHANICAL HEARING TRANSDUCTION

(75) Inventors: Vincent Pluvinage, Atherton, CA (US); Rodney C. Perkins, Woodside, CA (US)

(73) Assignee: EarLens Corporation, Redwood City, CA (US)

( * ) Notice: Subject to any disclaimer, the term of this patent is extended or adjusted under 35 U.S.C. 154(b) by 0 days.

(21) Appl. No.: 12/959,934

(22) Filed: Dec. 3, 2010

(65) Prior Publication Data

US 2011/0077453 A1 Mar. 31, 2011

Related U.S. Application Data

(62) Division of application No. 11/248,459, filed on Oct. 11, 2005.

(60) Provisional application No. 60/618,408, filed on Oct. 12, 2004.

(51) Int. Cl.
*H04R 25/00* (2006.01)

(52) U.S. Cl.
USPC ..... 600/25

(58) Field of Classification Search
USPC ..... 600/25; 181/129–130; 381/23.1, 60, 381/312–331, 380–381; 623/10; 607/55–56
See application file for complete search history.

(56) References Cited

U.S. PATENT DOCUMENTS 3,440,314 A 4/1969 Frisch
3,549,818 A 12/1970 Turner et al.
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord (Continued)

FOREIGN PATENT DOCUMENTS

AU 2004-301961 A1 2/2005
DE 2044870 A1 3/1972

(Continued)

OTHER PUBLICATIONS

Athanassiou A, Kalyva M, Lakiotaki K, Georgiou S, Fotakis C. Laser Controller Mechanical Actuation of Photochromic-Polymer Microsystems. Rev. Adv. Mater. Sci 5; 245-251, 2003.*

(Continued)

*Primary Examiner* — Charles A Marmor, II
*Assistant Examiner* — Catherine E Burk
(74) *Attorney, Agent, or Firm* — Wilson Sonsini Goodrich & Rosati

(57) ABSTRACT

Hearing systems for both hearing impaired and normal hearing subjects comprise an input transducer and a separate output transducer. The input transducer will include a light source for generating a light signal in response to either ambient sound or an external electronic sound signal. The output transducer will comprise a light-responsive transducer component which is adapted to receive light from the input transducer. The output transducer component will vibrate in response to the light input and produce vibrations in a component of a subject's hearing transduction pathway, such as the tympanic membrane, a bone in the ossicular chain, or directly on the cochlea, in order to produce neural signals representative of the original sound.

27 Claims, 6 Drawing Sheets

(56) References Cited

U.S. PATENT DOCUMENTS 3,882,285 A 5/1975 Nunley et al.
3,985,977 A 10/1976 Beaty et al.
4,002,897 A 1/1977 Kleinman et al.
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,766,607 A 8/1988 Feldman
4,774,933 A 10/1988 Hough et al.
4,776,322 A 10/1988 Hough et al.
4,800,884 A 1/1989 Heide et al.
4,817,607 A 4/1989 Tatge
4,840,178 A 6/1989 Heide et al.
4,845,755 A 7/1989 Busch et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,999,819 A 3/1991 Newnham et al.
5,003,608 A 3/1991 Carlson
5,012,520 A 4/1991 Steeger
5,015,224 A 5/1991 Mariglia
5,015,225 A 5/1991 Hough et al.
5,031,219 A 7/1991 Ward et al.
5,061,282 A 10/1991 Jacobs
5,066,091 A 11/1991 Stoy et al.
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A * 11/1993 Perkins et al. ..... 381/312
5,272,757 A 12/1993 Scofield et al.
5,276,910 A 1/1994 Buchele
5,277,694 A 1/1994 Leysieffer et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,606,621 A 2/1997 Reiter et al.
5,624,376 A 4/1997 Ball et al.
5,707,338 A 1/1998 Adams et al.
5,715,321 A 2/1998 Andrea et al.
5,721,783 A 2/1998 Anderson
5,729,077 A 3/1998 Newnham et al.
5,740,258 A 4/1998 Goodwin-Johansson
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Muller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,940,519 A 8/1999 Kuo
5,949,895 A 9/1999 Ball et al.
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,135,612 A * 10/2000 Clore ..... 362/184
6,137,889 A * 10/2000 Shennib et al. ..... 381/328
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,261,224 B1 7/2001 Adams et al.
6,277,148 B1 8/2001 Dormer
6,312,959 B1 * 11/2001 Datskos ..... 436/147
6,339,648 B1 1/2002 McIntosh et al.
6,354,990 B1 3/2002 Juneau et al.
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,493,454 B1 12/2002 Loi et al.
6,519,376 B2 2/2003 Biagi et al.
6,536,530 B2 3/2003 Schultz et al.
6,537,200 B2 3/2003 Leysieffer et al.
6,549,633 B1 4/2003 Westermann
6,554,761 B1 4/2003 Puria et al.
6,575,894 B2 6/2003 Leysieffer et al.

(56) References Cited

U.S. PATENT DOCUMENTS

| | | | |
|---|---|---|---|
| 6,592,513 | B1 | 7/2003 | Kroll et al. |
| 6,603,860 | B1 | 8/2003 | Taezner et al. |
| 6,620,110 | B2 | 9/2003 | Schmid |
| 6,626,822 | B1 | 9/2003 | Jaeger et al. |
| 6,629,922 | B1 | 10/2003 | Puria et al. |
| 6,668,062 | B1 | 12/2003 | Luo et al. |
| 6,676,592 | B2 | 1/2004 | Ball et al. |
| 6,695,943 | B2 | 2/2004 | Juneau et al. |
| 6,724,902 | B1 | 4/2004 | Shennib et al. |
| 6,728,024 | B2 | 4/2004 | Ribak |
| 6,735,318 | B2 | 5/2004 | Cho |
| 6,754,358 | B1 | 6/2004 | Boeson et al. |
| 6,801,629 | B2 | 10/2004 | Brimhall et al. |
| 6,829,363 | B2 | 12/2004 | Sacha |
| 6,842,647 | B1 | 1/2005 | Griffith et al. |
| 6,888,949 | B1 | 5/2005 | Vanden Berghe et al. |
| 6,900,926 | B2 | 5/2005 | Ribak |
| 6,912,289 | B2 | 6/2005 | Vonlanthen et al. |
| 6,920,340 | B2 | 7/2005 | Laderman |
| 6,940,989 | B1 | 9/2005 | Shennib et al. |
| D512,979 | S | 12/2005 | Corcoran et al. |
| 6,975,402 | B2 | 12/2005 | Bisson et al. |
| 6,978,159 | B2 | 12/2005 | Feng et al. |
| 7,043,037 | B2 | 5/2006 | Lichtblau |
| 7,050,675 | B2 | 5/2006 | Zhou |
| 7,072,475 | B1 | 7/2006 | DeNap et al. |
| 7,076,076 | B2 | 7/2006 | Bauman |
| 7,095,981 | B1 | 8/2006 | Voroba et al. |
| 7,167,572 | B1 | 1/2007 | Harrison et al. |
| 7,174,026 | B2 | 2/2007 | Niederdrank |
| 7,203,331 | B2 | 4/2007 | Boesen |
| 7,239,069 | B2 | 7/2007 | Cho |
| 7,245,732 | B2 | 7/2007 | Jorgensen et al. |
| 7,255,457 | B2 | 8/2007 | Ducharme et al. |
| 7,266,208 | B2 | 9/2007 | Charvin et al. |
| 7,289,639 | B2 | 10/2007 | Abel et al. |
| 7,322,930 | B2 | 1/2008 | Jaeger et al. |
| 7,376,563 | B2 | 5/2008 | Leysieffer et al. |
| 7,421,087 | B2 | 9/2008 | Perkins et al. |
| 7,444,877 | B2 | 11/2008 | Li et al. |
| 7,867,160 | B2 | 1/2011 | Pluvinage et al. |
| 2001/0024507 | A1 | 9/2001 | Boesen |
| 2001/0027342 | A1 | 10/2001 | Dormer |
| 2002/0012438 | A1 | 1/2002 | Leysieffer et al. |
| 2002/0030871 | A1 | 3/2002 | Anderson et al. |
| 2002/0086715 | A1 | 7/2002 | Sahagen |
| 2002/0172350 | A1 | 11/2002 | Edwards et al. |
| 2002/0183587 | A1 | 12/2002 | Dormer |
| 2003/0064746 | A1 | 4/2003 | Rader et al. |
| 2003/0125602 | A1 | 7/2003 | Sokolich et al. |
| 2003/0142841 | A1 | 7/2003 | Wiegand |
| 2003/0208099 | A1 | 11/2003 | Ball |
| 2004/0165742 | A1 | 8/2004 | Shennib et al. |
| 2004/0202340 | A1 | 10/2004 | Armstrong et al. |
| 2004/0208333 | A1 | 10/2004 | Cheung et al. |
| 2004/0234089 | A1 | 11/2004 | Rembrand et al. |
| 2004/0234092 | A1 | 11/2004 | Wada et al. |
| 2004/0240691 | A1 | 12/2004 | Grafenberg |
| 2005/0020873 | A1 | 1/2005 | Berrang et al. |
| 2005/0036639 | A1 | 2/2005 | Bachler et al. |
| 2005/0163333 | A1 | 7/2005 | Abel et al. |
| 2005/0226446 | A1 | 10/2005 | Luo et al. |
| 2006/0023908 | A1 | 2/2006 | Perkins et al. |
| 2006/0062420 | A1 | 3/2006 | Araki |
| 2006/0107744 | A1 | 5/2006 | Li et al. |
| 2006/0177079 | A1 | 8/2006 | Baekgaard Jensen et al. |
| 2006/0233398 | A1 | 10/2006 | Husung |
| 2006/0251278 | A1 | 11/2006 | Puria et al. |
| 2007/0083078 | A1 | 4/2007 | Easter et al. |
| 2007/0100197 | A1 | 5/2007 | Perkins et al. |
| 2007/0127748 | A1 | 6/2007 | Carlile et al. |
| 2007/0127766 | A1 | 6/2007 | Combest |
| 2007/0135870 | A1 | 6/2007 | Shanks et al. |
| 2007/0191673 | A1 | 8/2007 | Ball et al. |
| 2007/0236704 | A1 | 10/2007 | Carr |
| 2007/0250119 | A1 | 10/2007 | Tyler et al. |
| 2007/0286429 | A1 | 12/2007 | Grafenberg et al. |
| 2008/0021518 | A1 | 1/2008 | Hochmair et al. |
| 2008/0051623 | A1 | 2/2008 | Schneider et al. |
| 2008/0107292 | A1 | 5/2008 | Kornagel |
| 2009/0092271 | A1 | 4/2009 | Fay et al. |
| 2009/0097681 | A1 | 4/2009 | Puria et al. |
| 2010/0034409 | A1 | 2/2010 | Fay et al. |
| 2010/0048982 | A1 | 2/2010 | Puria et al. |
| 2010/0202645 | A1 | 8/2010 | Puria et al. |

FOREIGN PATENT DOCUMENTS

| | | | | |
|---|---|---|---|---|
| DE | 3243850 | A1 | 5/1984 | |
| DE | 3508830 | A * | 9/1986 | ..... H04R 25/00 |
| EP | 0296092 | A2 | 12/1988 | |
| EP | 0296092 | A3 | 8/1989 | |
| EP | 1845919 | | 10/2007 | |
| FR | 2455820 | A1 | 11/1980 | |
| JP | 60-154800 | A | 8/1985 | |
| JP | 2004-187953 | A | 7/2004 | |
| WO | WO 97/45074 | A1 | 12/1997 | |
| WO | WO 99/03146 | A1 | 1/1999 | |
| WO | WO 99/15111 | A1 | 4/1999 | |
| WO | WO 01/50815 | A1 | 7/2001 | |
| WO | WO 01/58206 | A2 | 8/2001 | |
| WO | WO 01/58206 | A3 | 2/2002 | |
| WO | WO 03/063542 | A2 | 7/2003 | |
| WO | WO 03063542 | A2 * | 7/2003 | |
| WO | WO 03/063542 | A3 | 1/2004 | |
| WO | WO 2004/010733 | A1 | 1/2004 | |
| WO | WO 2005/015952 | A1 | 2/2005 | |
| WO | WO 2006/042298 | A2 | 4/2006 | |
| WO | WO 2006/075175 | A1 | 7/2006 | |
| WO | WO 2006/042298 | A3 | 10/2006 | |

OTHER PUBLICATIONS

English Language translation of DE 3508830 A, translated Oct. 27, 2006.*

U.S. Appl. No. 60/702,532, filed Jul. 25, 2005, Aljuri.

U.S. Appl. No. 61/073,271, filed Jun. 17, 2008, Felsenstein.

U.S. Appl. No. 61/073,281, filed Jun. 17, 2008, Felsenstein.

U.S. Appl. No. 61/099,087, filed Sep. 22, 2008, Rucker.

Atasoy [Paper] Opto-acoustic Imaging. for BYM504E Biomedical Imaging Systems class at ITU, downloaded from the Internet www2.itu.edu.td-cilesiz/courses/BYM504- 2005-OA 504041413.pdf, 14 pages.

Athanassiou, et al. Laser controlled photomechanical actuation of photochromic polymers Microsystems. Rev. Adv. Mater. Sci. 2003; 5:245-251.

Ayatollahi, et al. Design and Modeling of Micromachined Condenser MEMS Loudspeaker using Permanent Magnet Neodymium—Iron—Boron (Nd—Fe—B). IEEE International Conference on Semiconductor Electronics, 2006. ICSE '06, Oct. 29, 2006-Dec. 1, 2006; 160-166.

Best, et al. The influence of high frequencies on speech localization. Abstract 981 (Feb. 24, 2003) from www.aro.org/abstracts/abstracts.html.

Birch, et al. Microengineered systems for the hearing impaired. IEE Colloquium on Medical Applications of Microengineering, Jan. 31, 1996; pp. 2/1-2/5.

Burkhard, et al. Anthropometric Manikin for Acoustic Research. J. Acoust. Soc. Am., vol. 58, No. 1, (Jul. 1975), pp. 214-222.

Camacho-Lopez, et al. Fast Liquid Crystal Elastomer Swims Into the Dark, Electronic Liquid Crystal Communications. Nov. 26, 2003; 9 pages total.

Cheng, et al. A Silicon Microspeaker for Hearing Instruments. Journal of Micromechanics and Microengineering 2004; 14(7):859-866.

Datskos, et al. Photoinduced and thermal stress in silicon microcantilevers. Applied Physics Letters. Oct. 19, 1998; 73(16):2319-2321.

Fay, et al. Cat eardrum response mechanics. Mechanics and Computation Division. Department of Mechanical Engineering. Standford University. 2002; 10 pages total.

(56) References Cited

OTHER PUBLICATIONS

Fletcher. Effects of Distortion on the Individual Speech Sounds. Chapter 18, ASA.
Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Hofman, et al. Relearning Sound Localization With New Ears. Nature Neuroscience, vol. 1, No. 5, (Sep. 1998); 417-421.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lezal. Chalcogenide glasses—survey and progress. Journal of Optoelectronics and Advanced Materials. Mar. 2003; 5(1):23-34.
Moore. Loudness perception and intensity resolution. Cochlear Hearing Loss, Chapter 4, pp. 90-115, Whurr Publishers Ltd., London (1998).
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements In The Cochlear Vestibule of Human-Cadaver Ears. Journal of the Acoustical Society of America. 1997; 101 (5-1): 2754-2770.
Sekaric, et al. Nanomechanical resonant structures as tunable passive modulators. App. Phys. Lett. Nov. 2003; 80(19):3617-3619.
Shih. Shape and displacement control of beams with various boundary conditions via photostrictive optical actuators. Proc. IMECE. Nov. 2003; 1-10.
Stuchlik, et al. Micro-Nano actuators driven by polarized light. IEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
International search report and written opinion dated Sep. 20, 2006 for PCT/US2005/036756.
EAR. Retrieved from the Internet: http://wwwmgs.bionet.nsc.ru/mgs/gnw/trrd/thesaurus/Se/ear.html. Accessed Jun. 17, 2008.
Headphones. Wikipedia Entry, downloaded from the Internet: http://en.wikipedia.org/wiki/Headphones. Accessed Oct. 27, 2008.
Lee, et al. A Novel Opto-Electromagnetic Actuator Coupled to the tympanic.Membrane. J Biomech. Dec. 5, 2008;41(16):3515-8. Epub Nov. 7, 2008
U.S. Appl. No. 12/244,266, filed Oct. 2, 2008, Fay et al.
Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Carlile, et al. Spatialisation of talkers and the segregation of concurrent speech. Abstract 1264 (Feb. 24, 2004) from www.aro.org/abstracts/abstracts.html.
Decraemer, et al. A method for determining three-dimensional vibration in the ear. Hearing Res., 77:19-37 (1994).
European search report and opinion dated Jun. 12, 2009 for EP 06758467.2.
Hato, et al. Three-dimensional stapes footplate motion in human temporal bones. Audiol. Neurootol., 8:140-152 (Jan. 30, 2003).
International search report and written opinion dated Aug. 7, 2009 for PCT/US2009/047682.
International search report and written opinion dated Oct. 17, 2007 for PCT/US2006/015087.
International search report and written opinion dated Nov. 23, 2009 for PCT/US2009/047685.
International search report and written opinion dated Dec. 8, 2008 for PCT/US2008/078793.
International search report and written opinion dated Dec. 24, 2008 for PCT/US2008/079868.
Lee, et al. The optimal magnetic force for a novel actuator coupled to the tympanic membrane: a finite element analysis. Biomedical engineering: applications, basis and communications. 2007; 19(3):171-177.
Martin, et al. Utility of Monaural Spectral Cues is Enhanced in the Presence of Cues to Sound-Source Lateral Angle. JARO. 2004; 5:80-89.
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Shaw. Transformation of Sound Pressure Level From the Free Field to the Eardrum in the Horizontal Plane. J. Acoust. Soc. Am., vol. 56, No. 6, (Dec. 1974), 1848-1861.

(56) References Cited

OTHER PUBLICATIONS

Sound Design Technologies,—Voyager TDTM Open Platform DSP System for Ultra Low Power Audio Processing—GA3280 Data Sheet. Oct. 2007; retrieved from the Internet: <<http://www.sound-des.com/pdf/37601DOC.pdf>>, 15 pages total.

Thompson. Tutorial on microphone technologies for directional hearing aids. Hearing Journal. Nov. 2003; 56(11):14-16,18, 20-21.

Vickers, et al. Effects of Low-Pass Filtering on the Intelligibility of Speech in Quiet for People With and Without Dead Regions at High Frequencies. J. Acoust. Soc. Am., vol. 110, No. 2, (Aug. 2001), pp. 1164-1175.

* cited by examiner

SYSTEMS AND METHODS FOR PHOTO-MECHANICAL HEARING TRANSDUCTION

CROSS-REFERENCES TO RELATED APPLICATIONS

The present application is a Divisional of U.S. Ser. No. 11/248,459 filed Oct. 11, 2005 (Allowed); which application is a non-provisional of U.S. 60/618,408 filed Oct. 12, 2004; the full disclosures of which are incorporated herein by reference in their entirety for all purposes.

BACKGROUND OF THE INVENTION

1. Field of the Invention

The present invention relates generally to systems and methods for sound transduction. In particular, the present invention relates to the use of light signals for producing vibrational energy in a transduction pathway from a subject's tympanic membrane to the subject's cochlea.

A wide variety of hearing aids and ear pieces have been produced over the years to provide sound directly into a subject's ear. Most such hearing systems rely on acoustic transducers that produce amplified sound waves which impart vibrations directly to the tympanic membrane or ear drum of the subject. Hearing aids generally have a microphone component which converts ambient sounds into electrical signals which are then amplified into the sound waves. Telephone and other ear pieces, in contrast, convert and amplify electronic or digital signals from electronic sources into the desired sound waves.

Such conventional hearing aids and ear pieces suffer from a number of limitations. Some limitations are aesthetic, including the size and appearance of hearing aids which many users find unacceptable. Other problems are functional. For example, the production of amplified sound waves within the ear canal can result in feedback to the microphone in many hear aid designs. Such feedback limits the degree of amplification available. Most hearing aids and other types of ear pieces include an element large enough to obstruct the natural geometry of the ear canal, limiting the ability of natural sounds to reach the tympanic membrane and sometimes inhibiting the ear to respond to changes in ambient pressure. The precise shape of the external ear and the ear canal determine acoustic coupling of ambient sounds with the eardrum, determining in part the relative strength of various sound frequencies. An object inserted into the ear canal substantially changes this acoustic coupling, the person's perception of ambient sounds is distorted. These deficiencies can be a particular concern with the use of ear pieces in normal hearing individuals. Additionally, the acoustic coupling of the output transducers of many conventional hearing systems with the middle ear is often inadequate and seldom adequately controlled. Such deficiencies in coupling can introduce acoustic distortions and losses that lessen the perceived quality of the amplified sound signal.

An improved hearing system useful both as a hearing aid and an ear piece is described in U.S. Pat. No. 5,259,032. A magnetic transducer is held on a plastic or other support which is suspended directly on the outer surface of a subject's tympanic membrane by surface tension in a drop of mineral oil. The magnet is driven by a driver transducer assembly which receives ambient sound or an electronic sound signal and which generates an electromagnetic field, typically by passing electric current through a coil. The driver transducer will usually be disposed within the subject's ear canal, but could also be worn externally, as disclosed for example in U.S. Pat. No. 5,425,104.

The use of a magnetic transducer disposed directly on the tympanic membrane has a number of advantages. The risk of feedback is greatly reduced since there is no amplified sound signal. The coupling of the magnet or other transducer to the driver transducer is limited since the strength of the generated magnetic field decreases with distance rapidly, at a rate approximately proportional to the cube of the distance from the coil. The strength will conversely increase with the diameter of the coil. The inventions disclosed in U.S. Pat. Nos. 5,259,032 and 5,425,104 at least partly overcome these limitations. The two proposed designs attempt to provide enough electromagnetic coupling between the coil and the magnet to produce vibrations that are perceived as being sufficiently loud. As described in U.S. Pat. No. 5,425,104, a large coil around the subject's neck is used to drive the transducer and the ear canal is free from the presence of driving coil. The amount of current required to overcome the distance between the coil and the magnet in the eardrum has limited the usefulness of that approach. In the case of the small coil in the ear canal, the electromagnetic driving assembly must be very close to the eardrum (and yet not risk touching it) but the coil and its ferromagnetic core must be of such a size to effectively couple with the magnet that the driving assembly will affect the acoustics of the ear canal. Thus, while the magnetic transducer can be small enough to fit inside the ear canal, it will affect the natural sound shaping characteristics of the unobstructed ear.

Another limitation on the strength of the magnetic field produced by the coil is the need to align the axis of the driver coil and with the center of the coil and the center of the magnet on the eardrum transducer. The magnetic coupling will necessarily vary significantly with variations of such angle.

As a consequence the distance and the angle of the driver coil with respect to the magnet must be carefully controlled to avoid significant variations in magnetic coupling that would otherwise changes the perceived loudness produced with given amplitude of signal driving the coil. A further issue arises from the fact that the shape of the ear canal and the angle of the ear canal with the eardrum varies from person to person. Thus, in order to maintain a constant and precise coupling each and every time the subject inserts the coil assembly into the ear canal, it is necessary to consider embedding the coil driver assembly into a custom fitted mold which will position the coil assembly each time in the same relative position. Such custom assembly increases the cost of the products, and even relatively small pressure on the walls of the ear canal, which are very sensitive, can be uncomfortable (either during the insertion of the mold or while wearing it for extended period of time).

Various implantable hearing aids have also been developed which are unobtrusive and which generally avoid problems associated with feedback. For example, U.S. Pat. Nos. 6,629,922 and 6,084,957 disclose flextensional actuators which are surgically implanted to drive the ossicular chain (comprising the middle-ear bones) or the inner-ear fluid in the cochlea. U.S. Pat. No. 5,554,096 describes a floating mass transducer which can be attached to drive the mastoid bone or other element in the ossicular chain. Additionally, U.S. Pat. No. 5,772,575 describes the use of ceramic (PLZT) disks implanted in the ossicular chain of the middle ear. While effective, each of these devices requires surgical implantation and transcutaneous electrical connection to external driving circuitry. The internal electrical connection of the vibrating drive elements is potentially prone to failure over time and unless properly shielded, can be subject to electromagnetic interferences from common sources of electromagnetic field such as metal detectors, cellular telephone or MRI machines and the likes.

For these reasons, it would be desirable to provide hearing systems including both hearing aids and ear pieces which are unobtrusive, which do not occupy a significant portion of the ear canal from a cosmetic and an acoustical point of view, which provide efficient energy transfer and extended battery life, and which avoid feedback problems associated with amplified sound systems which are disposed in the ear canal. It would be further desirable if such hearing systems in at least some embodiments would avoid the need for surgical implantation, avoid the need for transcutaneous connection, provide for failure-free connections between the driving electronics and the driving transducer, and be useful in systems for both hearing impaired and normal hearing persons.

Finally, it would be useful if the amount of custom manufacturing required to achieve an acceptable performance could be minimized. At least some of these objectives will be met by the inventions described hereinbelow.

2. Description of the Background Art

Hearing transduction systems are described in U.S. Pat. Nos. 5,259,032; 5,425,104; 5,554,096; 5,772,575; 6,084,975; and 6,629,922. Opto-accoustic and photomechanical systems for converting light signals to sound are described in U.S. Pat. Nos. 4,002,897; 4,252,440; 4,334,321; 4,641,377; and 4,766,607. Photomechanical actuators comprising PLZT are described in U.S. Pat. Nos. 4,524,294 and 5,774,259. A thermometer employing a fiberoptic assembly disposed in the ear canal is described in U.S. Pat. No. 5,167,235. The full disclosures of each of these prior U.S. patents are incorporated herein by reference.

Materials which deform in response to exposure to light are known. The use of a photostrictive material (PLZT) to produce sound in a "photophone" has been suggested. The use of PLZT materials as light-responsive actuators is described in Thakoor et al. (1998), SPIE 3328:376-391; Shih and Tzou (2002) Proc. IMECE pp. 1-10; and Poosanaas et al. (1998) J. App. Phys. 84:1508-1512. Photochromic and other polymers which deform in response to light are described in Athanossiou et al. (2003) *Rev. Adv. Mater. Sci* 5:245-251; Yu et al. (2003) *Nature* 425:145; and Camacho-Lopez et al. (2003) Electronic Liquid Crystal Communications. Silicon nanomechanical resonant structures which deform in response to light are described in Sekaric et al. (2002) *App. Phys. Lett.* 80:3617-3619. The use of chalcogenide glasses which reversibly respond to light and can be used to design light-driven actuators is described in M. Stuchlik et al (2004). The full disclosures of each of these publications are incorporated herein by reference. The use of chalcogenide glasses as light-driven actuators is described in Stuchlik et al (2004) *IEEE Proc.-Sci. Meas. Technol.* 15: 131-136.

BRIEF SUMMARY OF THE INVENTION

The present invention provides improved systems and methods for inducing neural impulses in the hearing transduction pathway of a human subject, where those impulses are interpreted as sound by the subject. The systems comprise an input transducer assembly which converts ambient sound or an electronic sound signal into a light signal and an output transducer assembly which receives the light signal and converts the light signal to mechanical vibration. The output transducer assembly is adapted to couple to a location in the hearing transduction pathway from the subject's tympanic membrane (eardrum) to the subject's cochlea to induce the neural impulses. The input transducer assembly may be configured as a hearing aid and/or as an ear piece (or a combination of both) to be coupled to an electronic sound source, such as a telephone, a cellular telephone, other types of communication devices, radios, music players, and the like. When used as part of a hearing aid, input transducer assembly will typically comprise a microphone which receives ambient sound to generate the electronic sound signal and a light source which receives the electronic sound signal and produces the light signal. When used as part of a communications or other device, the input transducer assembly typically comprises a receiver or amplifier which receives electronic sound information from the electronic source to generate an electronic sound signal and a light source which receives the electronic sound signal to produce the light signal.

The input transducer assembly will often be configured to be worn behind the pinna of the subject's ear in a manner similar to a conventional hearing aid. Alternatively, the transducer assembly could be configured to be worn within the ear canal, in the temple pieces of eyeglasses, or elsewhere on the subject such as in the branches of eyeglasses. In most cases, the input transducer assembly will further comprise a light transmission component which delivers light from the light source to the output transducer assembly. Typically, the light transmission component will be adapted to pass through the subject's auditory canal (ear canal) to a position adjacent to the output transducer assembly. In the most common embodiments, the output transducer assembly will reside on the tympanic membrane, and the light transmission component will have a distal terminal end which terminates near the output transducer assembly. Thus, the light transmission component will preferably not be mechanically connected to the output transducer assembly, and there will typically be a gap from 2 mm to 20 mm, preferably from 4 mm to 12 mm, between the distal termination end of the light transmission component and the output transducer assembly. This gap is advantageous since it allows the output transducer assembly to float freely on the tympanic membrane without stress from the light transmission component, and with minimum risk of inadvertent contact with the light transmission component. Additionally, there is no connection between the light transmission component and the output transducer assembly which is subject to mechanical or electrical failure.

Light, unlike an electromagnetic field produce by a coil, does not suffer from large changes in intensity resulting from small variations in distance or angle. Simply put, the laws of physics that govern the propagation of light describe the fact the light intensity will not substantially change over the distances considered in this application. Furthermore, if the "cone of light" produced between the end of the transmission element and the light-sensitive opto-mechanical transducer has an appropriate angle, small changes in the relative angle between the light transmission element and the output transducer will have no substantial change in the light energy received by the light sensitive area of the output transducer. Because the transmission of power and information using light is far less sensitive to distance and angle than when using electromagnetic field, the energy coupling between the input and output transducers of this invention is far less dependent on the exact position between them. This reduces the need for very tight tolerances designing the overall system, and hence eliminating the requirement for a custom manufactured input transducer mold. As compared to the prior art, the present invention can reduce the manufacturing costs, improve the comfort, simplify the insertion and removal of the input transducer, and allow for less potential changes in the energy coupling between the input and the output transducers.

In other embodiments, the output transducer assembly may be configured to be implanted within the middle ear, typically being coupled to a bone in the ossicular chain or to the cochlea to induce vibration in the cochlear or middle ear fluids. In those embodiments, the light transmission component will usually be configured to pass transcutaneously from the external input transducer assembly to a position adjacent to the implanted output transducer assembly. Alternatively, the light transmission element could end just prior to the external side of the eardrum and transmit across the eardrum either through an small opening or simply by shining thru the thin tympanic membrane. For such implanted output transducer assemblies, it may be desirable to physically connect the light transmission member to the output transducer assembly, although such connection will not be necessary.

The present invention is not limited to output transducers that are manually releasable from the eardrum. In other embodiments, the output transducer may be attached to the eardrum or to the side of the malleus bone in contact with the tympanic membrane. Such attachment may be permanent or may be reversible, whether manually releasable or not.

In still further embodiments, the input transducer assembly may comprise a light source which is located immediately adjacent to the output transducer assembly, thus eliminating the need for a separate light transmission component. Usually, in those cases, the light transducer component will be connected to the remaining portions of the input transducer assembly using electrical wires or other electrical transmission components.

In all embodiments, the input transducer assembly may be connected to other electronic sources or components using wireless links, such as electronic links using the Bluetooth standard. Wired connections to other external and peripheral components will of course also be possible.

The output transducer assembly will typically comprise a transducer component and a support component. In the case of output transducer assemblies which are to be positioned on the tympanic membrane, the support component will typically have a geometry which conforms to the surface of the tympanic membrane and can be adapted to be held in place by surface tension. The design and construction of such support components is well described in prior U.S. Pat. No. 5,259,032, the full disclosure of which has previously been incorporated herein by reference. It will be appreciated, of course, that the support component can also be configured to permit the output transducer assembly to be mounted on a bone in the ossicular chain, on an external portion of the cochlea in order to vibrate the fluid within the cochlea, or elsewhere in the hearing transduction pathway between the tympanic membrane and the cochlea.

In a preferred embodiment where the support component is adapted to contact the tympanic membrane, the surface of the support component will have an area sufficient for manually releasably supporting the output transducer assembly on the membrane. Usually, the support component will comprise a housing at least partially enclosing the transducer component, typically fully encapsulating the transducer component. A surface wetting agent may be provided on the surface of the support component which contacts the tympanic membrane. Alternatively, the polymer used to fabricate the output transducer may provide sufficient coupling forces with the tympanic membrane without the need to periodically apply such a wetting agent.

The output transducer component may be any type of "optical actuator" that can produce vibrational energy in response to light which is modulated or encoded to convey sound information. Suitable materials which respond directly to light (and which need no additional power source) include photostrictive materials, such as photostrictive ceramics and photostrictive polymers; photochromic polymers; silicon-based semiconductor materials, chalcogenide glasses and the like. A particularly suitable photostrictive ceramic is composed with a solid solution of lead titanate and lead zirconate, referred to as PLZT. PLZT displays both a piezoelectric effect and a photovoltaic effect so that it produces mechanical strain when irradiated by light, referred to as a photostrictive effect. Another particularly suitable design are chalcogenide glasses cantilevers, which when illuminated with polarized light at the appropriate wavelength respond by bending reversibly. By modulating the light, vibrations can be induced.

PLZT and other photostrictive ceramics may be configured as a bimorph where two layers of the PZLT are laminated or may be configured as a thin layer of the ceramic on a substrate. The composition of suitable PLZT photostrictive ceramics are described in the following references which are incorporated herein by reference:

"Mechanochemical Synthesis of Piezoelectric PLZT Powder" by Kenta Takagi, Jing-Feng Li, Ryuzo Watanabe; in KONA No. 21 (2003).

The construction and use of PLZT in photostrictive actuators is described in:

"Photostricitve actuators" by K. Uchino, P. Poosanaas, K. Tonooka; in Ferroelectrics (2001), Vol. 258, pp 147-158.

"OPTICAL MICROACTUATION IN PIEZOCERAMICS", by Santa Thakoor, p Poosanaas, J M. Morookian, A. Yavrouian, L. Lowry, N. Marzwell, J G. Nelson, R. R. Neurgaonkar, d K. Uchino.; in SPIE Vol. 3328•0277-786X198

Suitable photostrictive and photochromic polymers are described in "Laser controlled photomechanical actuation of photochromic polymers Microsystems" by A. Athanassiou et al; in *Rev. Adv. Mater. Sci.,* 5 (2003) 245-251.

Suitable silicon-based semiconductor materials include, are described in the following references:

"Optically activated ZnO/SiO2/Si cantilever beams" by Suski J, Largeau D, Steyer A, van de Pol F C M and Blom F R, in *Sensors Actuators* A 24 221-5

See also U.S. Pat. No. 6,312,959 and U.S. Pat. No. 6,385,363 as well as Photoinduced and thermal stress in silicon microcantilevers by Datskos et al; in APPLIED PHYSICS LETTERS VOLUME 73, NUMBER 16 19 Oct. 1998.

Suitable chalcogenide glasses are described in the following references.

"CHALCOGENIDE GLASSES-SURVEY AND PROGRESS", by D. Lezal in Journal of Optoelectronics and Advanced Materials Vol. 5, No. 1, March 2003, p. 23-34

"Micro-Nano actuators driven by polarized light" by M. Stuchlik et al, in *IEE Proc. Sci. Meas. Techn*. March 2004, Vol 151 No 2, pp 131-136.

Other materials can also exhibit photomechanical properties suitable for this invention, as described broadly in:

"Comments on the physical basis of the active materials concept" by P. F. Gobbin et al; in *Proc. SPIE* 4512, pp 84-92; as well as in "Smart Materials, Precision Sensors/Actuators, Smart Structures, and Structronic Systems", by H. S. TZOU et al; in *Mechanics of Advanced Materials and Structures,* 11: 367-393, 2004

The output transducer assembly may be configured in a variety of geometries which are suitable for coupling to the tympanic membrane, a bone in the ossicular chain, or onto a surface of the cochlea. Suitable geometries include flexible beams which flex in response to the light signal, convex membranes which deform in response to the light signal, and flextensional elements which deform in response to the light signal.

It will be clear to one skilled in the art that numerous configurations and design can be implemented and enabled to produce light-induced vibration. For example, a small cantilever coated with chalcogenide glass can be clamped at one end into the support element of the output transducer, while the other end of the cantilever is free to move. A small mass can be attached at the free end of the cantilever, to provide inertia. As the cantilever vibrates in response to light, the mass's inertia will produce a reactive force that transmits the vibration to the support element of the output transducer.

In addition to the systems just described, the present invention further comprises output transducer assemblies for inducing neural impulses in the human subject. The output transducer assemblies comprise a transducer component which receives light from an input transducer and converts the light into vibrational energy, wherein the transducer component is adapted to reside on a tympanic membrane. Additional aspects of the transducer assembly have been described above in connection with the systems of the present invention.

The present invention still further comprises an input transducer assembly for use in hearing transduction systems including an output transducer assembly. The input transducer assembly comprises a transducer component which receives ambient sound and converts said ambient sound to a light output and a transmission component which can deliver the light output through an auditory canal to an output transducer residing on the tympanic membrane. The transducer component of the assembly comprises a microphone which receives the ambient sound and generates an electrical signal and a light source which receives the electrical signal and produces the light signal. Other aspects of the input transducer assembly are as described previously in connection with the systems of the present invention.

The present invention still further comprises methods for delivering sound to a human subject. The methods comprise positioning a light-responsive output transducer assembly on a tympanic membrane of the user and delivering light to the output transducer assembly, where the light induced the output transducer assembly to vibrate in accordance with a sound signal. Positioning typically comprises placing the light-responsive output transducer assembly on the tympanic membrane in the presence of a surface wetting agent, wherein the output transducer assembly is held against the membrane by the surface tension. For example, the wetting agent may comprise mineral oil. The light-responsive output transducer assembly may be positioned, for example, over the tip of the manubrium.

The light-responsive output transducer usually comprises a transducer component and a support component. Positioning then comprises placing a surface of the support component against the tympanic membrane wherein the surface conforms to the membrane. As described above in connection with the systems of the present invention, the transducer component typically comprises a photostrictive material, a photochromic polymer, or a silicon based semiconductor material. The transducer may be configured in a variety of geometries, and delivering the light typically comprises directing the light over a transmission element which passes through the subject's auditory canal.

DETAILED DESCRIPTION OF THE INVENTION

Figure 1:
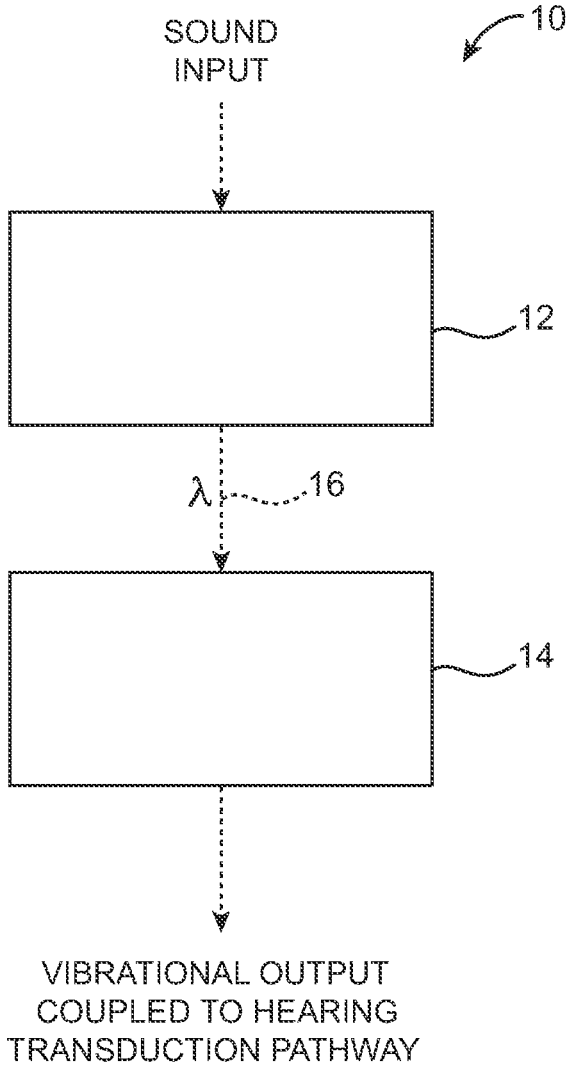
FIG. 1 is a block diagram illustrating the systems for inducing neural impulses in human subjects according to the present invention.

As shown schematically in FIG. 1, systems 10 constructed in accordance with the principles of the present invention will comprise an input transducer assembly 12 and an output transducer assembly 14. The input transducer assembly 12 will receive a sound input, typically either ambient sound (in the case of hearing aids for hearing impaired individuals) or an electronic sound signal from a sound producing or receiving device, such as the telephone, a cellular telephone, a radio, a digital audio unit, or any one of a wide variety of other telecommunication and/or entertainment devices. The input transducer assembly will produce a light output 16 which is modulated in some way, typically in intensity, to represent or encode a "light" sound signal which represents the sound input. The exact nature of the light input will be selected to couple to the output transducer assembly to provide both the power and the signal so that the output transducer assembly can produce mechanical vibrations which, when properly coupled to a subject's hearing transduction pathway, will induce neural impulses in the subject which will be interpreted by the subject as the original sound input, or at least something reasonably representative of the original sound input.

In the case of hearing aids, the input transducer assembly 12 will usually comprise a microphone integrated in a common enclosure or framework with a suitable light source. Suitable microphones are well known in the hearing aid industry and amply described in the patent and technical literature. The microphones will typically produce an electrical output, which, according to the present invention, will be directly coupled to a light transducer which will produce the modulated light output 16. As noted above, the modulation will typically be intensity modulation, although frequency and other forms of modulation or signal encoding might also find use.

In the case of ear pieces and other hearing systems, the sound input to the input transducer assembly 12 will typically be electronic, such as from a telephone, cell phone, a portable entertainment unit, or the like. In such cases, the input transducer assembly 12 will typically have a suitable amplifier or other electronic interface which receives the electronic sound input and which produces an electronic output suitable for driving the light source in the assembly.

For both hearing aids and other hearing systems, suitable light sources include any device capable of receiving the electronic drive signal and producing a light output of suitable frequency, intensity, and modulation. Particular values for each of these characteristics will be chosen to provide an appropriate drive signal for the output transducer assembly 14, as described in more detail below. Suitable light sources include light emitting diodes (LEDs), semiconductor lasers, and the like. A presently preferred light source is a gallium nitride ultraviolet LED having an output wavelength of 365 nm. This wavelength is in the ultraviolet region and is a preferred frequency for inducing a photostrictive effect in the exemplary PLZT ceramic and PLZT thin film output transducers, as described in the embodiments below. The LED should produce light having a maximum intensity in the range from 0.1 to 50 mW, preferably 1 to 5 mW, and a maximum current required to produced such light intensity that preferably does not exceed 100 mA, and typically shall not exceed 10 mA peak levels. Suitable circuitry within the output transducer assembly 12 will power the LED or other light source to modulate the light intensity, or its polariozation, delivered by the transducer to the output transducer 14. Depending on the type of material selected, more than one light wavelength may be used, and the relative intensity of the light beams of different color would then be modulated.

The light source will typically be contained within a primary housing 20 (FIG. 2) of the input transducer assembly 12. In the case of hearing aids, the microphone and other associated circuitry, as well as the battery, will usually be enclosed within the same housing 20. In the case of ear pieces and other hearing systems, the primary housing 20 may be modified to receive the sound electronic input and optionally power from another external source (not illustrated).

Light from the internal light source in housing 20 will be delivered to a target location near the output transducer by a light transmission element 22, typically a light fiber or bundle of light fibers, usually arranged as an optical waveguide with a suitable cladding. Optionally, a lens (not illustrated) may be provided at a distal end 24 of the waveguide to assist in focusing (or alternatively diffusing) light emanating from the waveguide, although usually a lens will not be required. The distal end of the light transmission element may include a small assembly designed to orient the light generally toward the light sensitive portion of the output transducer. Such assembly may be custom selected amongst a small number of shapes covering the normal range of ear canal anatomies. For example, radially inclined springs or slides may be provided to center the light transmission element and direct it toward the output transducer.

Alternatively, the light source may be located directly adjacent to the output transducer assembly. For example, if the light transmission member 22 were instead a support member having internal wires, a light source could be mounted at the distal end 24 to generate light in response to the electrical signals. Of course, it would also be possible to mount the light source within the housing 20 so that the light source could project directly from the housing toward the output transducer assembly 12. Each of these approaches will be discussed with respect to FIGS. 4 to 7 below.

The output transducer assembly 14 will be configured to couple to some point in the hearing transduction pathway of the subject in order to induce neural impulses which are interpreted as sound by the subject. Typically, the output transducer assembly 14 will couple to the tympanic membrane, a bone in the ossicular chain, or directly to the cochlea where it is positioned to vibrate fluid within the cochlea. Specific points of attachment are described in prior U.S. Pat. Nos. 5,259,032; 5,456,654; 6,084,975; and 6,629,922, the full disclosures of which have previously been incorporated herein by reference. A presently preferred coupling point is on the outer surface of the tympanic membrane.

Figure 3:
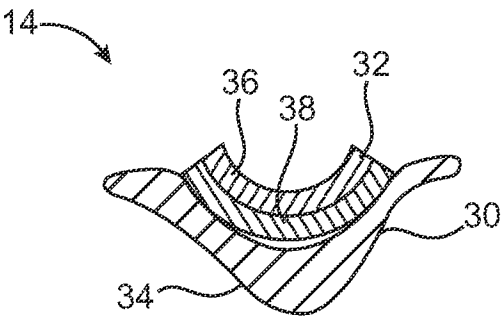
FIG. 3 illustrates an exemplary output transducer assembly comprising a support component and a bimorph ceramic transducer component useful in the systems and methods of the present invention.
Figure 4:
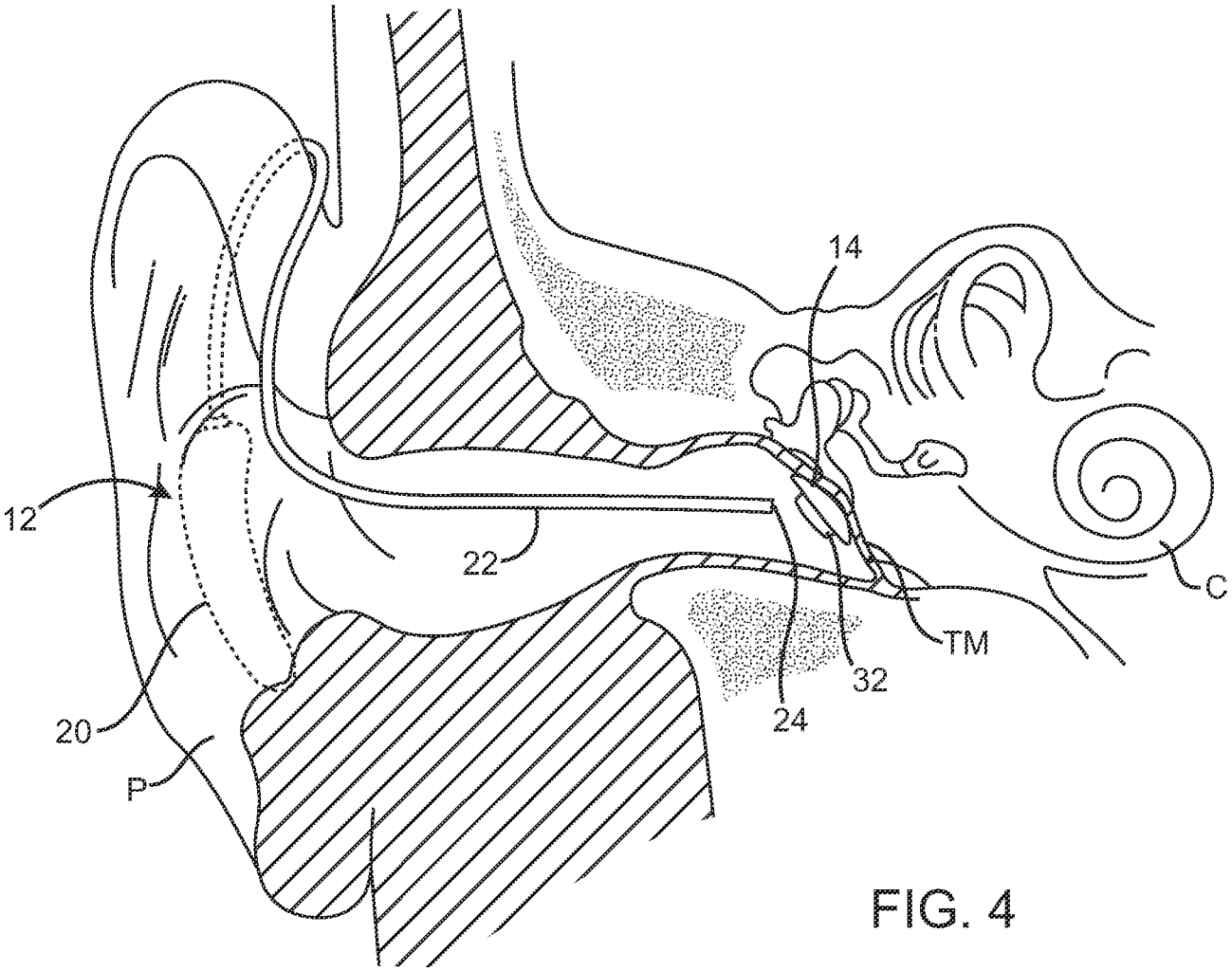
FIGS. 4 to 7 illustrate various system configurations in accordance with the principles of the present invention.

An output transducer assembly 14 particularly suitable for such placement is illustrated in FIG. 3. Transducer assembly 14 comprises a support component 30 and a transducer component 32. A lower surface 34 of the support component 30 is adapted to reside or "float" over a tympanic membrane TM, as shown in FIG. 4. The transducer component 32 may be any one of the transducer structures discussed above, but is illustrated as a bimorph ceramic transducer having opposed layers 36 and 38.

Referring now to FIG. 4, the output transducer assembly 14 is placed over the tympanic membrane TM, typically by a physician or other hearing professional. A thin layer of mineral oil or other surface active agent may optionally be placed over the eardrum. It is expected that the output transducer assembly 14 would remain generally in place over the tympanic membrane for extended periods, typically comprising months, years, or longer.

Figure 2:
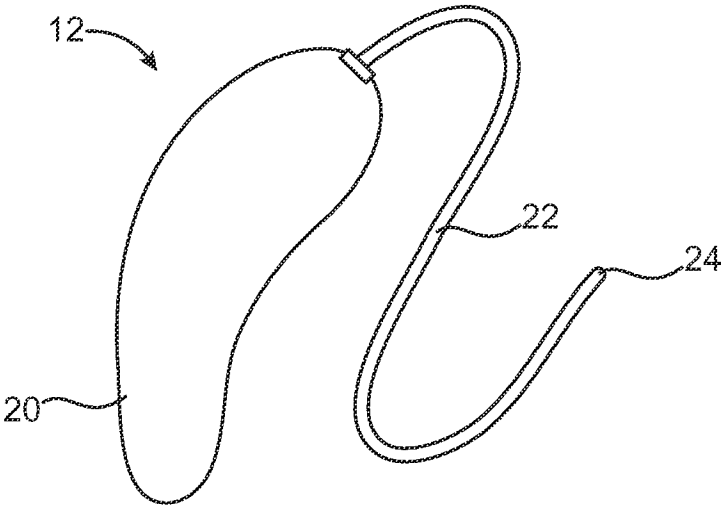
FIG. 2 illustrates an exemplary input transducer including a light transmission component useful in the systems and methods of the present invention.

To drive the output transducer assembly 14, as shown in FIG. 4, an input transducer assembly 12 of the type illustrated in FIG. 2 may be worn by the user with the housing 20 placed behind the user's pinna P of the ear. The light transmission member 22 is then passed over the top of the pinna P with the distal end 24 being positioned adjacent to but spaced a short distance from the transducer component 32 of the transducer assembly 14. Thus, light projected from the light transmission component 22 will be incident on the transducer component 32, causing the transducer component to vibrate and inducing a corresponding vibration in the tympanic membrane. Such induced vibration will pass through the middle ear to the cochlea C where neural impulses representing the original sound signal will be generated.

The system 10 consisting of the input transducer assembly 12 and output transducer assembly 14 is particularly advantageous since there is little or no risk of feedback since no amplified sound signal is being produced. The relatively low profile of the light transmission 22 does not block the auditory canal AC thus allowing ambient sound to reach the eardrum and not interfering with normal pressurization of the ear.

Figure 5:
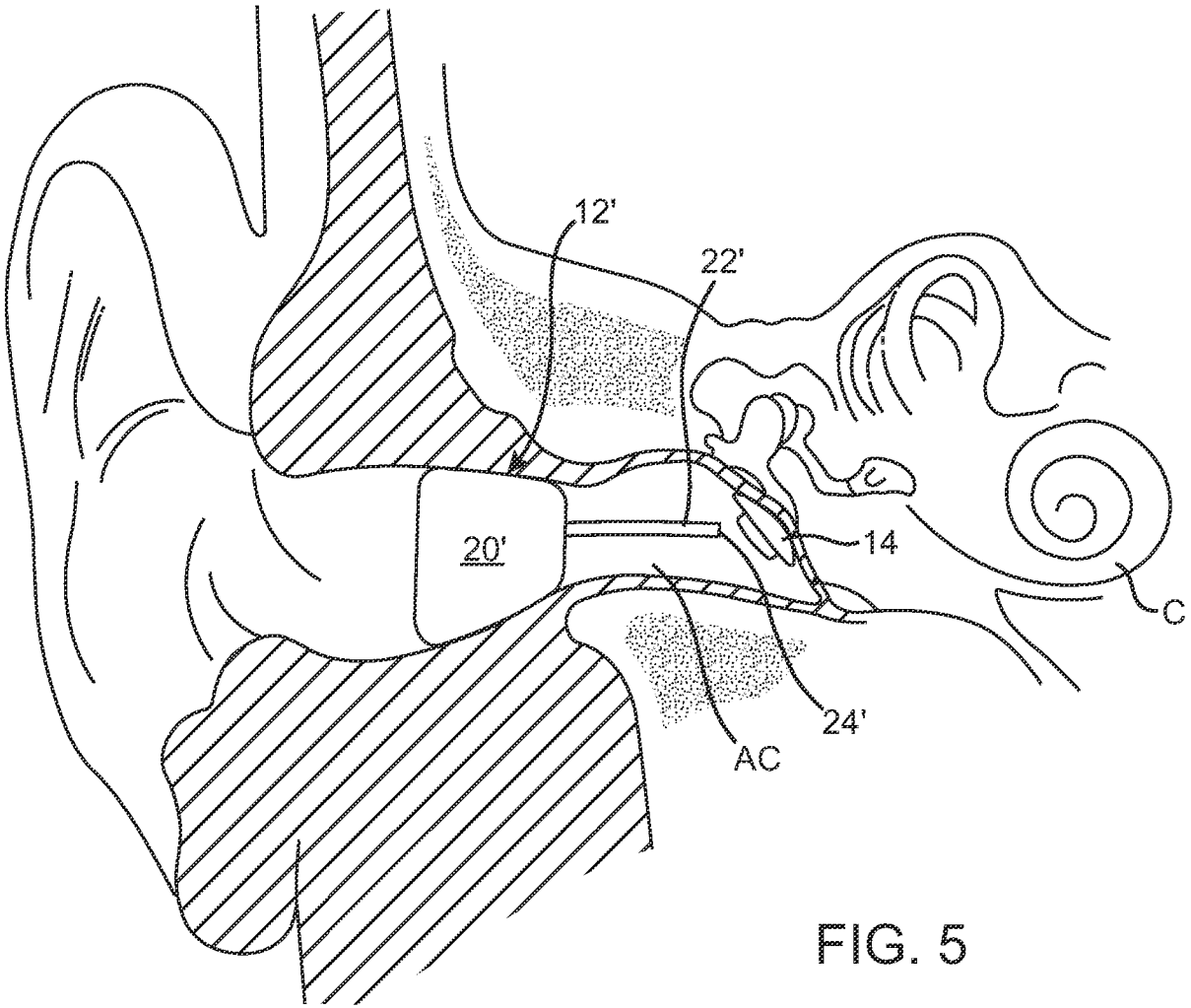

Referring now to FIG. 5, a input transducer 12' can be modified so that it is received fully within the auditory canal AC of the subject. Light transmission member 22' extends from a housing 20' and directs light from its distal end 24' toward the output transducer assembly 14. The system will thus function similarly to that shown in FIG. 4, except that the housing 20' will need to have sufficient openings to allow most or all of the acoustic sound waves to pass through unaffected and this avoiding to substantially block or occlude the auditory canal AC. The system of FIG. 5, however, would benefit from being virtually invisible when worn by the subject.

Figure 6:
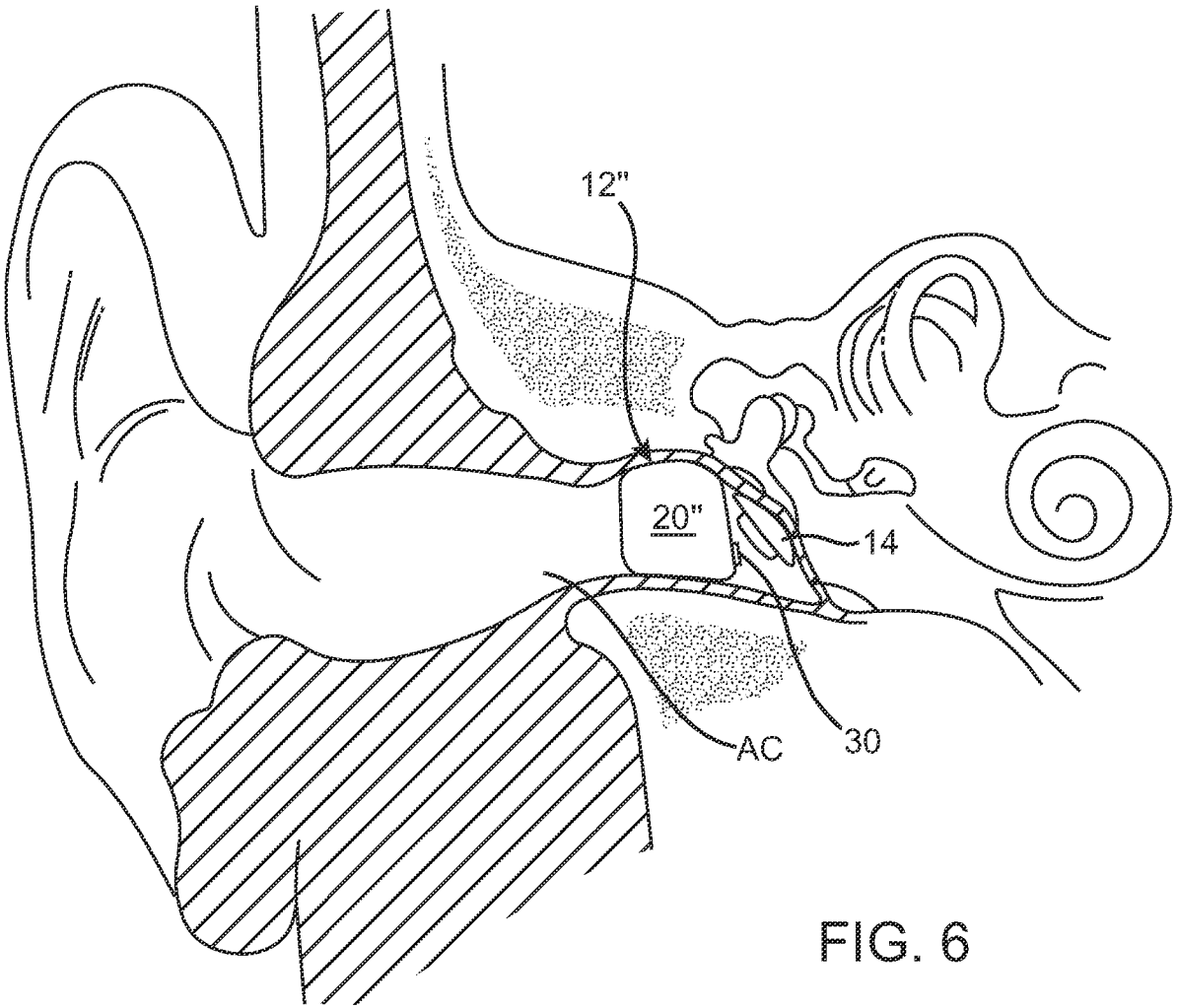

A further variation of the hearing system of the present invention is illustrated in FIG. 6. Here, an input transducer 12" comprises a housing 20" which is disposed in the innermost portion of the auditory canal AC immediately adjacent to the output transducer assembly 14. Light is directed from a port 30 on the housing 20" directly to the output transducer assembly 14. Thus, no separate light transmission element is required.

Figure 7:
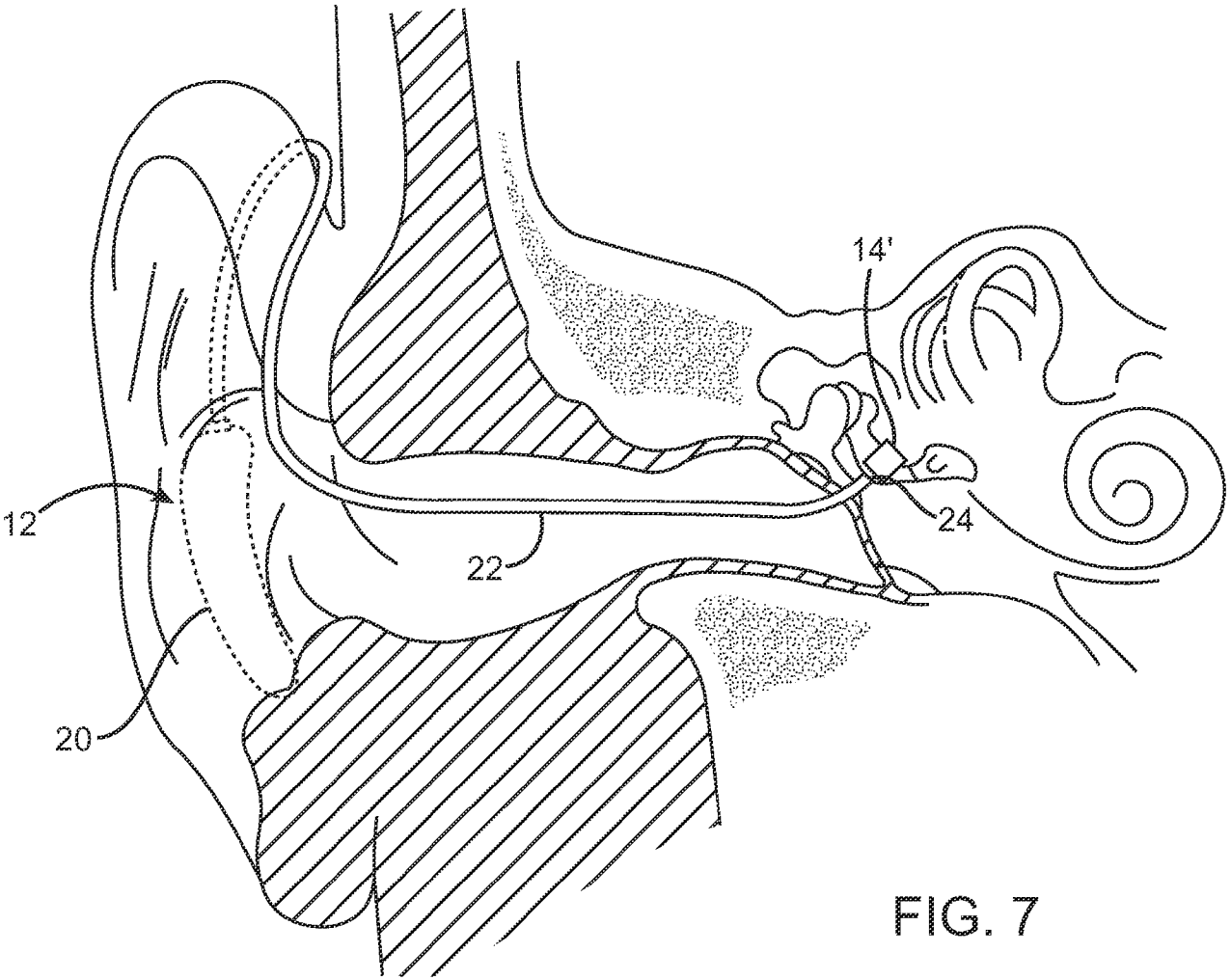

To this point, the output transducer assembly 14 has been illustrated as residing on the tympanic membrane TM. As discussed generally above, however, an output transducer assembly 14' may be located on other portions of the hearing transduction pathway. As shown in FIG. 7, the output transducer 14' is mounted on a bone in the ossicular chain. When the output transducer is located in the middle ear, as shown in FIG. 7, it will usually be necessary to extend the light transmission member 22 of the input transducer assembly 12 into the middle ear so that its distal end 24 can be located adjacent to the output transducer. For convenience, the light transmission member 22 is shown to penetrate the tympanic membrane. Other penetration points, however, may be preferred.

While the above is a complete description of the preferred embodiments of the invention, various alternatives, modifications, and equivalents may be used. Therefore, the above description should not be taken as limiting the scope of the invention which is defined by the appended claims.

What is claimed is:

1. A method for delivering sound to a human subject, said method comprising:

positioning a light-responsive output transducer assembly on a tympanic membrane of the user, the light-responsive output transducer assembly comprising a light sensitive area, wherein a support component of the output transducer assembly contacts an outer surface of the tympanic membrane such that the support component is releasable from the tympanic membrane;

providing an electrical signal in response to a sound signal;

generating modulated light energy in response to the electrical signal, the modulated light energy comprising optical power and an optical signal, the optical signal capable of transmitting the sound, the optical power capable of driving the output transducer assembly; and delivering the modulated light energy to the light sensitive area of the output transducer assembly, wherein the modulated light energy extends across a gap to the light sensitive area and drives the transducer assembly with the optical power and the optical signal and wherein the modulated light energy induces the output transducer assembly to vibrate in accordance with the sound signal.

2. A method as in claim 1, wherein positioning comprises placing the light-responsive output transducer assembly on the tympanic membrane in the presence of a surface wetting agent, wherein the output transducer assembly is held against the membrane by surface tension.

3. A method as in claim 2, wherein the surface wetting agent comprises an oil.

4. A method as in claim 1, wherein the light-responsive output transducer assembly is positioned over the tip of the manubrium.

5. A method as in claim 1, wherein the light-responsive output transducer comprises a transducer component.

6. A method as in claim 5, wherein the transducer component comprises a material selected from the group consisting of photostrictive materials, photochromic materials, silicon-based semiconductor materials, and chalcogenide glasses.

7. A method as in claim 6, wherein the transducer component comprises photostrictive materials comprising a ceramic.

8. A method as in claim 7, wherein the ceramic is configured as a bimorph.

9. A method as in claim 7, wherein the ceramic is deposited as a thin layer on a substrate.

10. A method as in claim 9, wherein the ceramic comprises PLZT.

11. A method as in claim 6, wherein the trandsducer component comprises photostrictive material comprising a photostrictive polymer.

12. A method as in claim 6, wherein the transducer component comprises a photochromic polymer.

13. A method as in claim 6, wherein the transducer component comprises a silicon based semiconductor material.

14. A method as in claim 1, wherein positioning comprises placing a surface of a support component against the tympanic membrane, wherein the surface conforms to the membrane and wherein the light energy comprises invisible light energy.

15. A method as in claim 14, wherein the surface conforms to the membrane in the presence of a surface wetting agent.

16. A method as in claim 1, wherein the output transducer assembly is configured as a flexible beam which flexes in response to the light energy, and carries mass to impact inertia to the coupling point in the hearing transduction pathway.

17. A method as in claim 1, wherein the output transducer assembly is configured as a convex membrane which deforms in response to the light energy.

18. A method as in claim 1, wherein the output transducer assembly is configured as a flextensional element which deforms in response to the light energy.

19. A method as in claim 1, wherein delivering further comprises directing the light over a transmission element which passes through the subject's auditory canal.

20. A method as in claim 19, wherein the light transmission element comprises at least one light transmission fiber.

21. A method as in claim 1, wherein the light comprises a first light beam and a second light beam, and wherein the first light beam and the second light beam are delivered to the output transducer assembly to vibrate the output transducer assembly in accordance with the sound signal.

22. A method as in claim 21, wherein the first light beam comprises a first wavelength of light and the second light beam comprises a second wavelength of light, the first wavelength of light different from the second wavelength of light.

23. A method as in claim 21, wherein the first wavelength of light comprises a first color of light and the second wavelength of light comprises a second color of light, the first color different than the second color.

24. A method as in claim 21, wherein a first intensity of the first wavelength of light and a second intensity of the second wavelength of light are modulated.

25. A method as in claim 1, wherein the modulated light energy comprises a cone of light energy extending across the gap to the light sensitive area of the output transducer assembly to drive the transducer assembly with the optical power and the optical signal.

26. A method for delivering a sound to a human subject having an ear, the ear having an auditory canal and a tympanic membrane, said method comprising:

positioning a light-responsive output transducer assembly in the auditory canal of the user, the light-responsive output transducer assembly comprising a light sensitive area, wherein a support component of the output transducer assembly contacts an outer surface of the tympanic membrane of the user such that the support component is releasable from the tympanic membrane;

providing an electrical signal in response to the sound;

generating light energy in response to the electrical signal, the light energy comprising optical power and an optical signal, the optical signal capable of transmitting the sound, the optical power capable of driving the output transducer assembly; and delivering the light energy to the light sensitive area of the output transducer assembly with a cone of the light energy, wherein the cone of the light energy extends across a gap to the light sensitive area to drive the transducer assembly with the optical power and the optical signal and wherein the cone extending to the light sensitive area induces the output transducer assembly to vibrate in accordance with the sound.

27. A method as in claim 26, wherein the sound comprises one or more of an ambient sound, an electronic sound, a telephone sound a cellular telephone sound, a radio sound or a musical sound.

* * * * *